US009184514B2

(12) United States Patent
Acera

(10) Patent No.: US 9,184,514 B2
(45) Date of Patent: Nov. 10, 2015

(54) WIRING STRUCTURE IMPROVEMENT OF INSULATION PIERCING CONNECTOR

(71) Applicant: Amphenol LTW Technology Co., Ltd., New Taipei (TW)

(72) Inventor: Jimmy Enrique Acera, New Taipei (TW)

(73) Assignee: AMPHENOL LTW TECHNOLOGY CO., LTD., New Taipei (TW)

( * ) Notice: Subject to any disclaimer, the term of this patent is extended or adjusted under 35 U.S.C. 154(b) by 29 days.

(21) Appl. No.: 14/304,780

(22) Filed: Jun. 13, 2014

(65) Prior Publication Data

US 2015/0280331 A1 Oct. 1, 2015

(30) Foreign Application Priority Data

Mar. 25, 2014 (TW) ..... 103205080 U

(51) Int. Cl.
*H01R 24/28* (2011.01)
*H01R 4/24* (2006.01)

(52) U.S. Cl.
CPC ..... *H01R 4/2433* (2013.01)

(58) Field of Classification Search
CPC .... H01R 24/28; H01R 13/627; H01R 4/2433; H01R 9/053; H01R 13/04
See application file for complete search history.

(56) References Cited

U.S. PATENT DOCUMENTS 3,980,380 A * 9/1976 Cieniawa ..... H01R 4/2429 439/404
6,877,222 B2 4/2005 Patel
2003/0060077 A1* 3/2003 Ferderer ..... H01R 4/2433 439/404
2003/0194890 A1* 10/2003 Ferderer ..... H01R 13/65802 439/98
2005/0090159 A1* 4/2005 Luther ..... H01R 4/4836 439/835
2005/0101181 A1* 5/2005 Bohn ..... H01R 4/2433 439/501
2009/0239423 A1 9/2009 Fitzpatrick et al.
2010/0027279 A1* 2/2010 Kotera ..... H01R 33/0854 362/418
2013/0323962 A1 12/2013 Chien

FOREIGN PATENT DOCUMENTS

CN 2549601 Y 5/2003
CN 1744381 A 3/2006
CN 200953419 Y 9/2007
CN 202142675 U 2/2012

(Continued)

OTHER PUBLICATIONS

Search Report dated Oct. 9, 2014 of the corresponding European patent application No. 14173743.7.

(Continued)

*Primary Examiner* — Truc Nguyen
(74) *Attorney, Agent, or Firm* — Chun-Ming Shih; HDLS IPR Services

(57) ABSTRACT

A wiring structure improvement of an insulation piercing connector for electrical connection after plural signal lines (40) being inserted includes a connector body (1), plural terminals (2) disposed in the connector body (1), and a rotary cable coupler (3). The connector body (1) has a wiring end (11). Each of the terminals (2) has a terminal body (20) and a piercing member (21) formed at one end of the terminal body (20) and disposed at the wiring end (11). The rotary cable coupler (3) is sleeved around the wiring end (11) and has plural plug holes (30) corresponding to the piercing members (21). Thus, when the rotary cable coupler (3) is rotated, the signal lines (40) are pushed by the plug holes (30) towards the piercing members (21) correspondingly such that the piercing members (21) pierce the signal lines (40) for the electrical connection.

12 Claims, 10 Drawing Sheets

(56) References Cited

FOREIGN PATENT DOCUMENTS

| | | | |
|---|---|---|---|
| CN | 102709729 | A | 10/2012 |
| DE | 102010041037 | A1 | 3/2012 |

OTHER PUBLICATIONS

Search Report dated Sep. 2, 2014 of the corresponding China patent application No. 201420139783.7.

* cited by examiner

WIRING STRUCTURE IMPROVEMENT OF INSULATION PIERCING CONNECTOR

BACKGROUND OF THE INVENTION

1. Field of the Invention

The present invention relates to a connector and, in particular, to a wiring structure improvement of an insulation piercing connector.

2. Description of Related Art

In a traditional electrical connector, the electrical connection between the signal lines and the terminals of the electrical connector or the PCB is mostly made by welding. However, in some occasions, the electrical connection is made by piercing and breaking the insulation layer covering the wire to expose the wire core therein; thus, the electrical connection can be made between the signal lines and the terminals.

However, in the traditional insulation piercing connector, the individual signal line is usually required to be inserted and pierced one by one, which is laborious and results in a higher defective rate associated with product assembly due to human error and thus needs improvements.

In view of foregoing, the inventor pays special attention to research with the application of related theory to propose the present invention, a reasonable design, to overcome the above disadvantages regarding the above related art.

SUMMARY OF THE INVENTION

The present invention is to provide a wiring structure improvement of an insulation piercing connector, which facilitates the insertion of signals lines into the insulation piercing connector via a rotary cable coupler and accomplishes the simultaneous tasks of piercing and electrical contact of all of the signal lines via the rotary cable coupler. In this way, human error and consuming working hours can be reduced.

The present invention provides a wiring structure improvement of an insulation piercing connector for electrical connection after a plurality of signal lines being inserted. The wiring structure improvement comprises a connector body, a plurality of terminals, and a rotary cable coupler. The connector body has a connecting end and a wiring end. The terminals are disposed in the connector body; each of the terminals has a terminal body which extends from the connecting end to the wiring end and a piercing member which is formed at one end of the terminal body and disposed at the wiring end. The rotary cable coupler is sleeved around the wiring end and has a plurality of plug holes corresponding to the piercing members for insertion of the signal lines. Whereby when the rotary cable coupler is rotated, the signal lines are pushed by the plug holes towards the piercing members correspondingly such that the piercing members pierce the signal lines for the electrical connection.

DETAILED DESCRIPTION OF THE INVENTION

To further disclose the features and technical details of the present invention, please refer to the following detailed description and accompanying figures associated with the present invention. However, the accompanying figures are only for reference and explanation, but not to limit the scope of the present invention.

Figure 1:
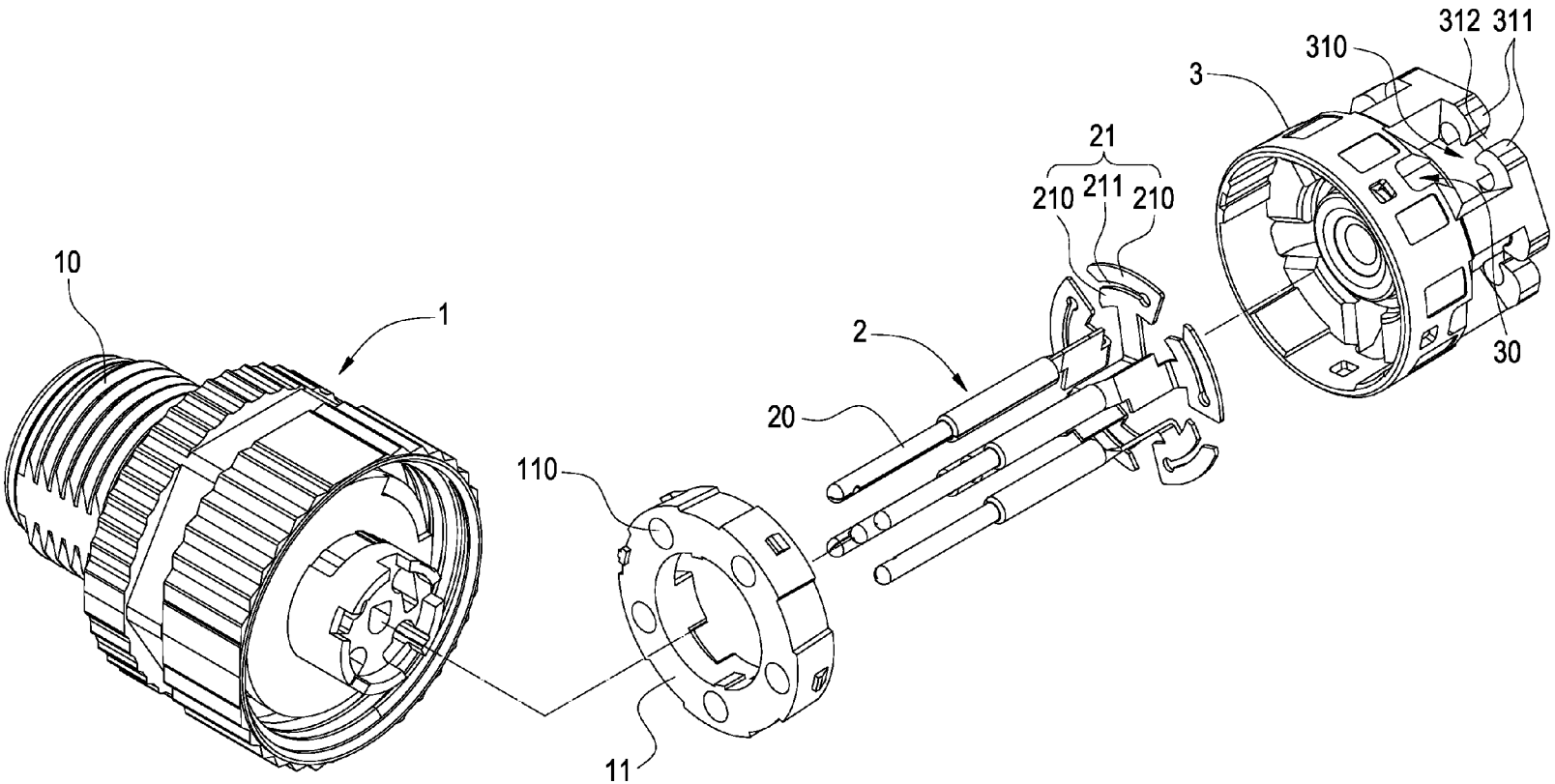
FIG. 1 is a perspective exploded view of the present invention.
Figure 2:
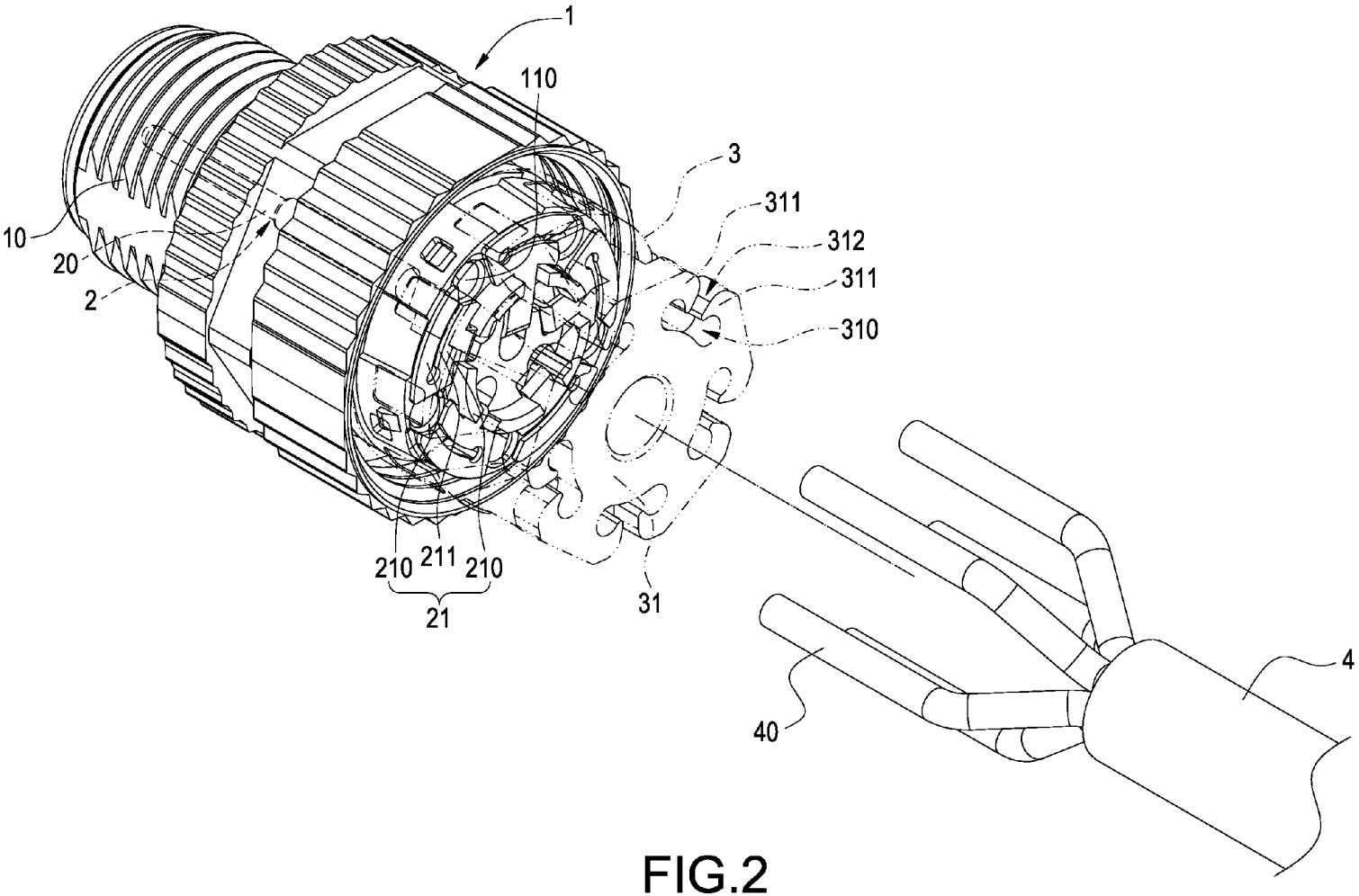
FIG. 2 is an exploded schematic view of the present invention for insertion of the signal lines.
Figure 3:
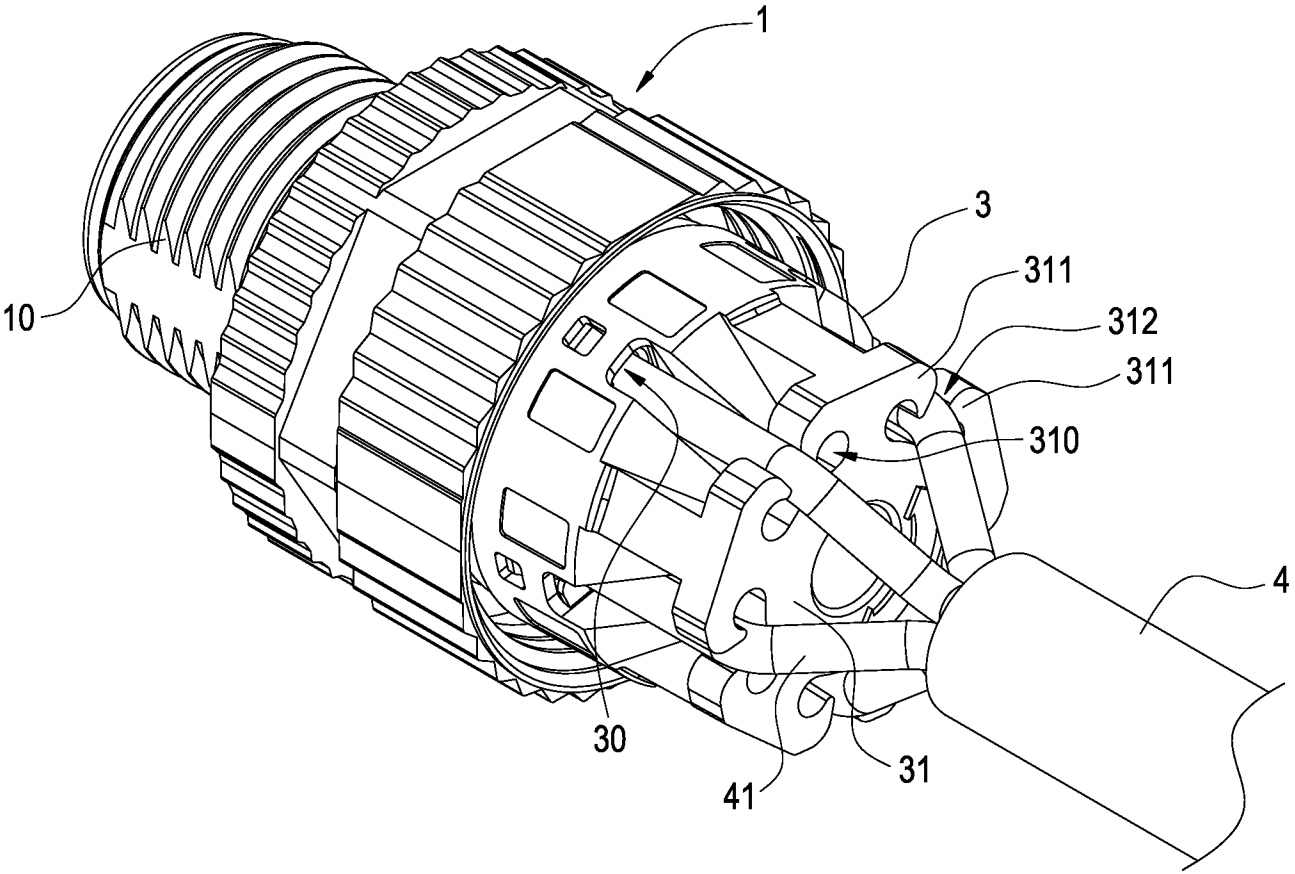
FIG. 3 is an assembled schematic view of the present invention for the insertion of the signal lines.

Please refer to FIGS. 1-3, which are a perspective exploded view, an exploded schematic view, and an assembled schematic view of the present invention for insertion of the signal lines, respectively. The present invention provides a wiring structure improvement of an insulation piercing connector for electrical connection after a plurality of signal lines 40 of a cable 4 being inserted. The wiring structure improvement comprises a connector body 1, a plurality of terminals 2, and a rotary cable coupler 3.

The connector body 1 may be a connector meeting one of different connector specifications. In the embodiments of the present invention, the connector body 1 which has a connecting end 10 and a wiring end 11 meets the specification of a cable connector. The connecting end 10 is used to connect with another connector (not shown); the wiring end 11 is used for electrical connection after the signal lines 40 being inserted. In general, the connecting end 10 and the wiring end 11 are disposed at two ends of the connector body 1, respectively, but not limited to this. Further, in the current embodiment, both of the connecting end 10 and the wiring end 11 are detachable. A plurality of through-holes 110 are disposed at the wiring end 11. The number of the through-holes 110 corresponds to that of the signal lines 40 for the insertion thereof.

The terminals 2 are disposed in the connector body 1. Each of the terminals 2 has a terminal body 20 and a piercing member 21 formed at one end of the terminal body 20. The terminal body 20 of the each of the terminals 2 extends from the connecting end 10 of the connector body 1 to the wiring end 11 such that the piercing member 21 of the each of the terminals 2 is disposed at the wiring end 11 and corresponds to one side of the respective through-hole 110. In more detail, the piercing members 21 are disposed on a side surface of the wiring end 11 and arranged circularly. In the embodiments of the present invention, each of the piercing members 21 has two spaced apart piercing blades 210; thus, a slot 211 is formed between the two piercing blades 210. The slots 211 are for receiving the signal lines 40 by push; thus, the insulation layers covering the signal lines 40 are pierced by the two piercing blades 210 to make the two piercing blades 210 contact with the wire cores 41 of the signal lines 40 (as shown in FIGS. 4 and 5).

The rotary cable coupler 3 may have a cap-like shape and is sleeved around the wiring end 11 of the connector body 1 to rotate clockwise or counterclockwise. The rotary cable coupler 3 has a plurality of plug holes 30 which correspond to the through-holes 110 of the wiring end 11 are adjacent to the piercing member 21 of the terminals 2, more specifically, to one side of the slot 211 of the piercing member 21. In the current embodiment, the rotary cable coupler 3 is further provided with a line fastener 31 having a plurality of fixing holes 310 corresponding to the respective plug holes 30. Each of the fixing holes 310 is formed and surrounded by two hook portions 311 oppositely spaced on the line fastener 31; thus, an embedded slot 312 is formed due to the two hook portions 311 being spaced opposite to each other. In this way, after the signal lines 40 are inserted into the plug holes 30, the portions of the signal lines 40 corresponding to the fixing holes 310 can be embedded in the fixing holes 310 through the embedded slots 312 and be fixed by the two hook portions 311 (as shown in FIG. 3).

Please refer to FIGS. 2 and 3. When the rotary cable coupler 3 is sleeved around the wiring end 11 of the connector body 1, each of the signal lines 40 can be inserted into the respective through-hole 110 of the wiring end 11 through the respective plug hole 30 of the rotary cable coupler 3 such that the each of the signal lines 40 protrudes at least beyond the side surface of the wiring end 11. Also, the slots 211 of the piercing members 21 can be arranged in either clockwise or counterclockwise direction when the rotary cable coupler 3 is sleeved around the wiring end 11. In the embodiments of the present invention, the slots 211 of the piercing members 21 are arranged in clockwise direction, so the rotary cable coupler 3 should be rotate counterclockwise. In other words, the direction of the arrangement of the slots 211 of the piercing members 21 is opposite to that of the rotation of the rotary cable coupler 3.

Figure 4:
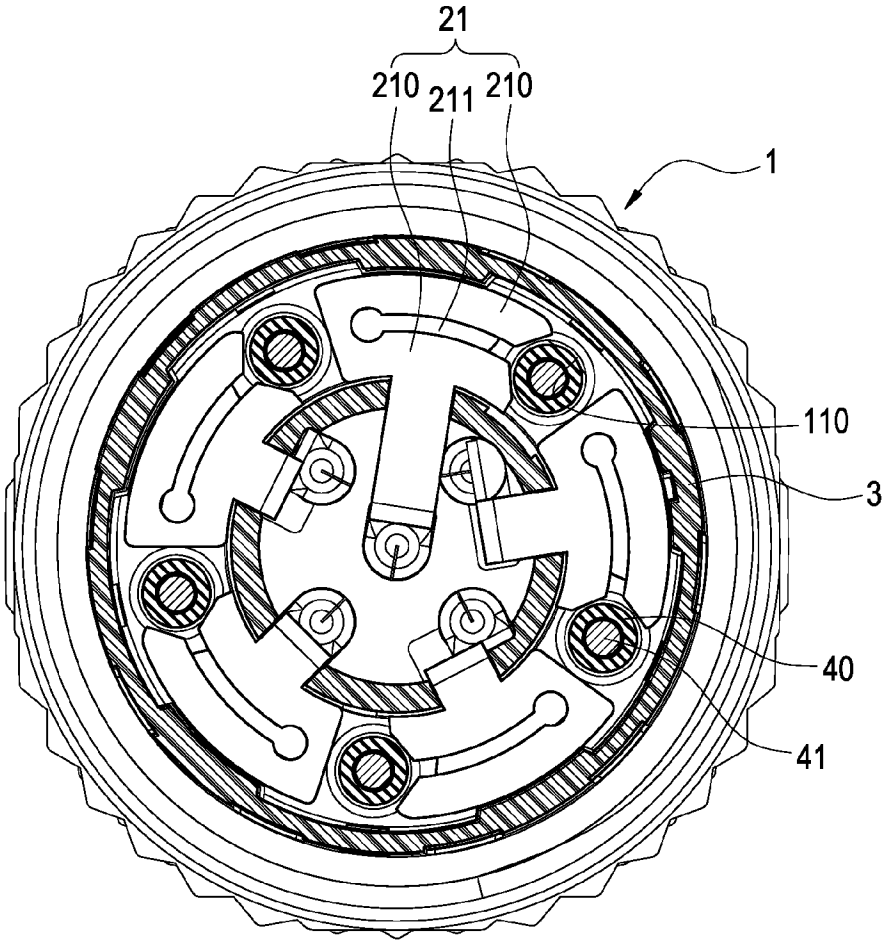
FIG. 4 is an actuating view of the present invention for the insertion of the signal lines.
Figure 5:
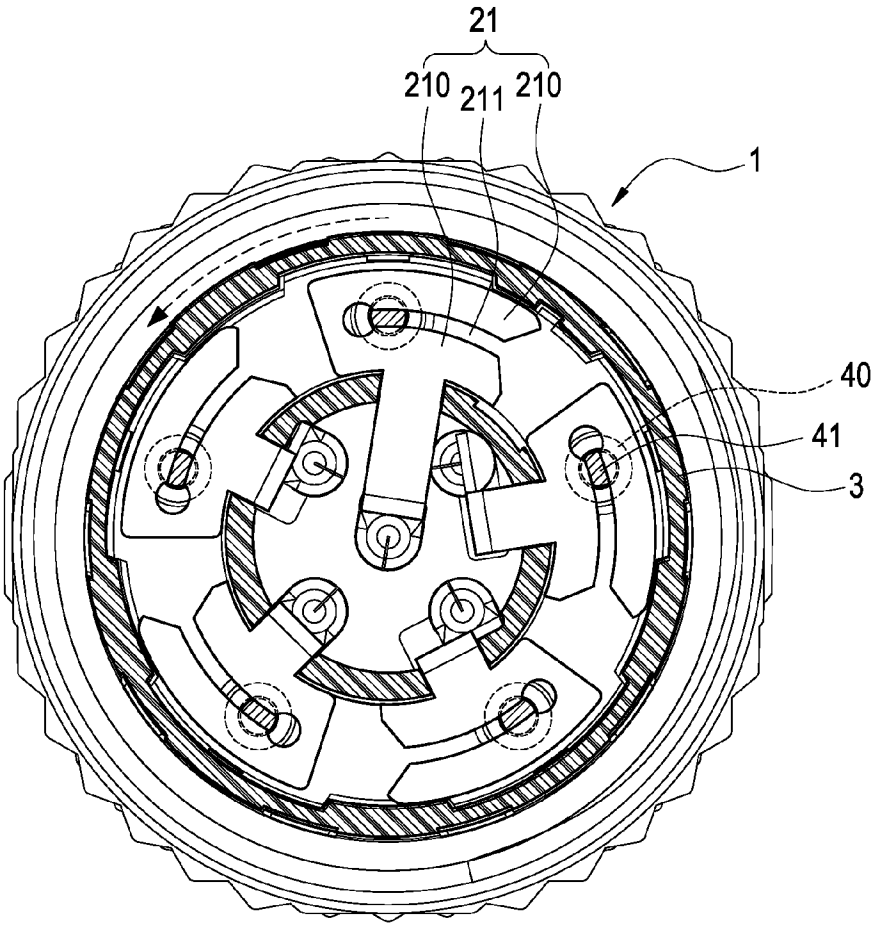
FIG. 5 is another actuating view of the present invention for the insertion of the signal lines.

As shown in FIG. 4, when the rotary cable coupler 3 rotates counterclockwise, the signal lines 40 can be pushed and moved by the plug holes 30 towards the slots 211 of the piercing members 21. Further, the slot 211 of the piercing member 21 has a "Y" shape to guide the signal line 40 towards between the two piercing blades 210. During the process of guiding the signal lines towards between the two piercing blades 210, the insulation layers covering the signal line 40 are pierced by the two piercing blades 210 to make the two piercing blades 210 contact with the wire cores 41 of the signal lines 40 to achieve the electrical connection, as shown in FIG. 5.

Figure 6:
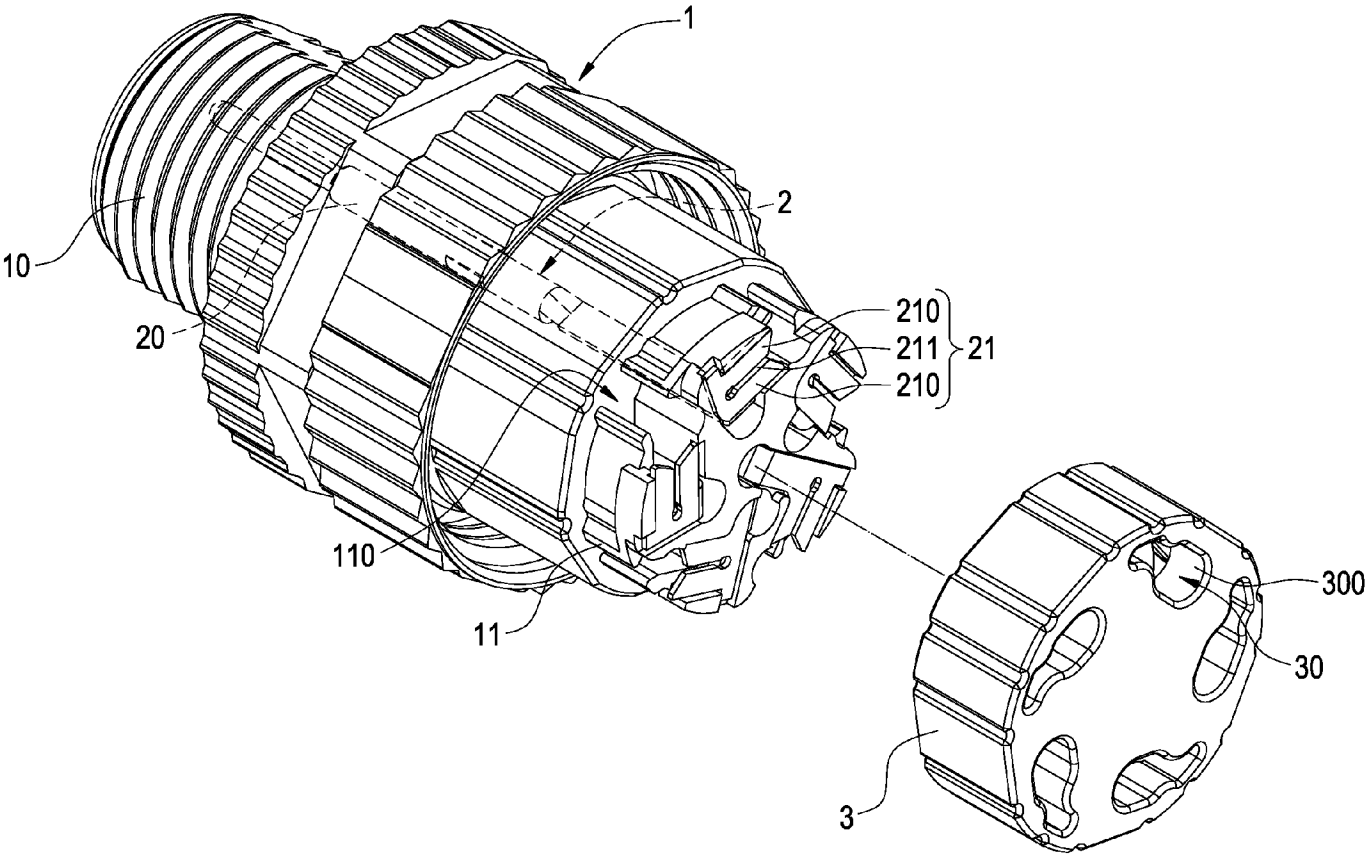
FIG. 6 is a perspective exploded view according to another embodiment of the present invention.
Figure 7:
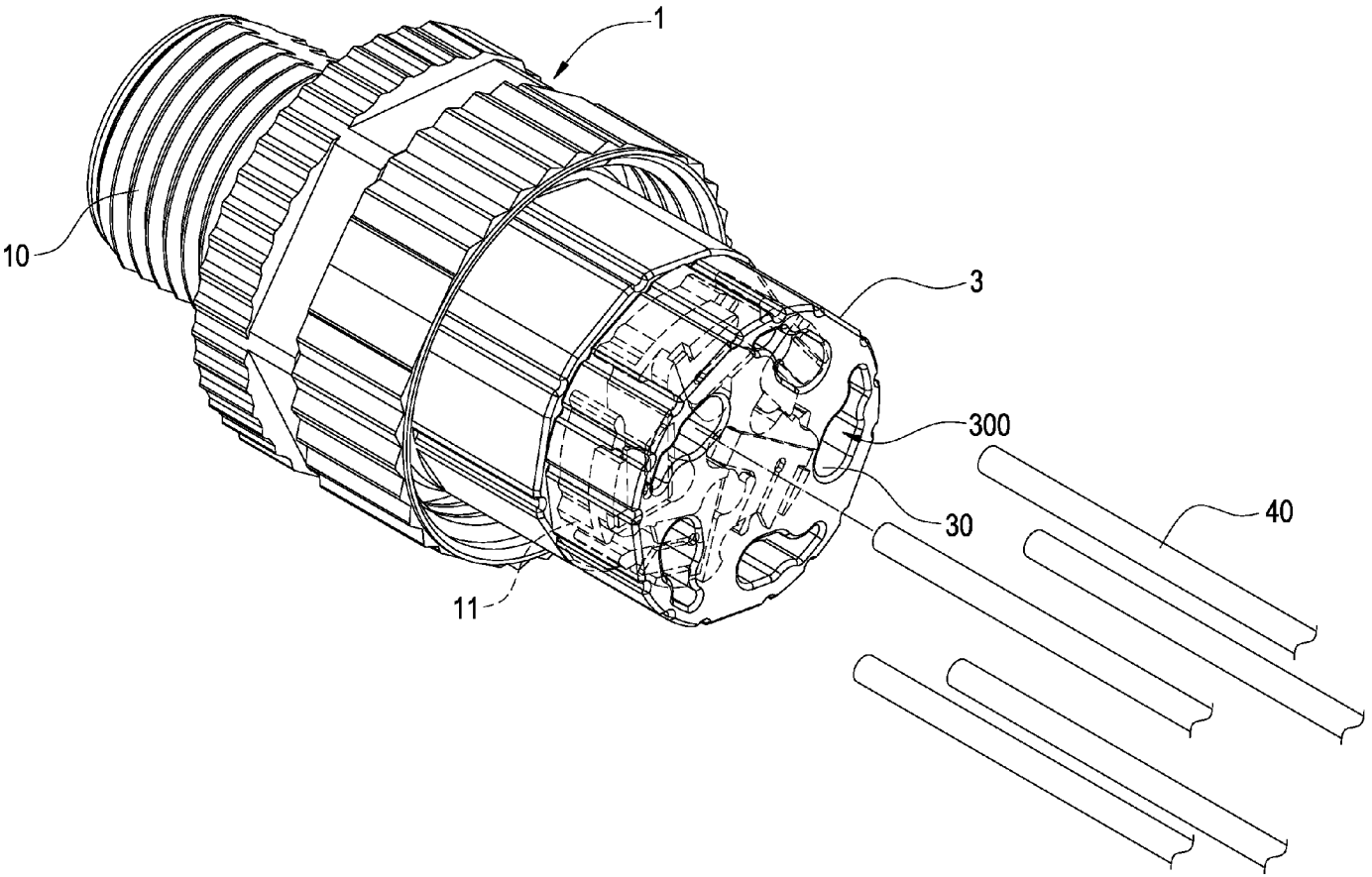
FIG. 7 is an exploded schematic view according to another embodiment of the present invention for insertion of the signal lines.

Moreover, as shown in FIGS. 6 and 7, which show a perspective exploded view and an exploded schematic view according to another embodiment of the present invention for insertion of the signal lines, respectively. The wiring end 11 and the connector body 1 can be integrally molded; the line fastener 31 of the rotary cable coupler 3 in the previous embodiment is omitted here. Also, in the current embodiment, each of the plug holes 30 of the rotary cable coupler 3 may have decreasing diameters. A pressing surface 300 for the insertion of the signal line 40 is disposed on an inner edge of the each of the plug holes 30, which is located at an end with the largest diameter.

Figure 8:
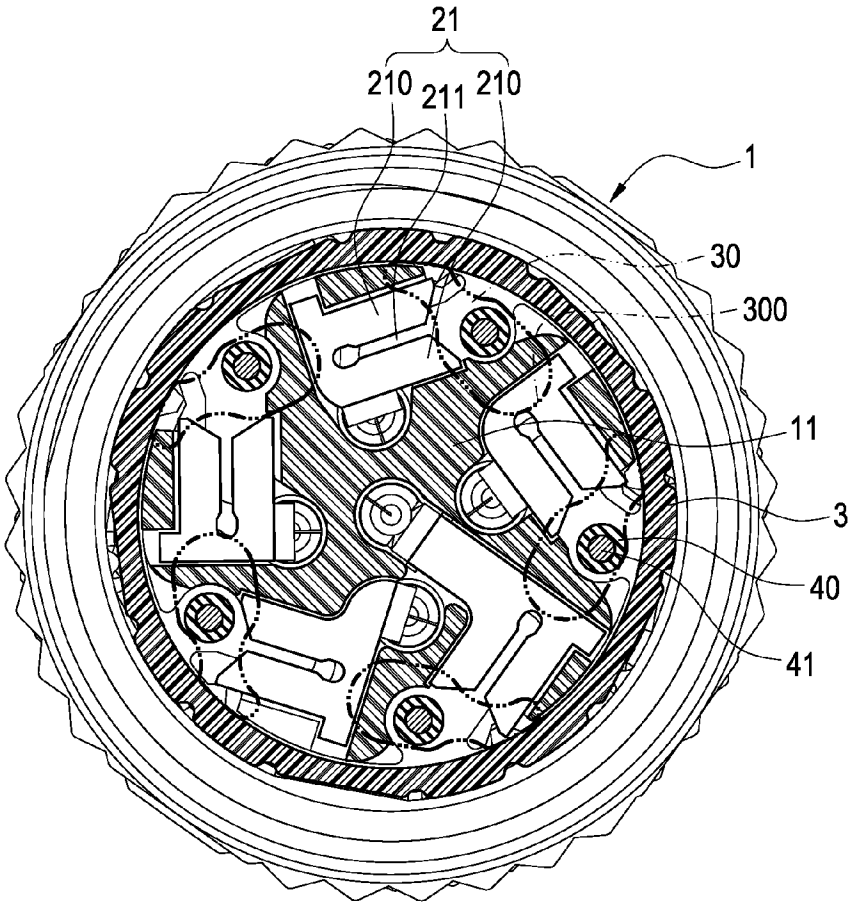
FIG. 8 is an actuating view according to another embodiment of the present invention for the insertion of the signal lines.
Figure 9:
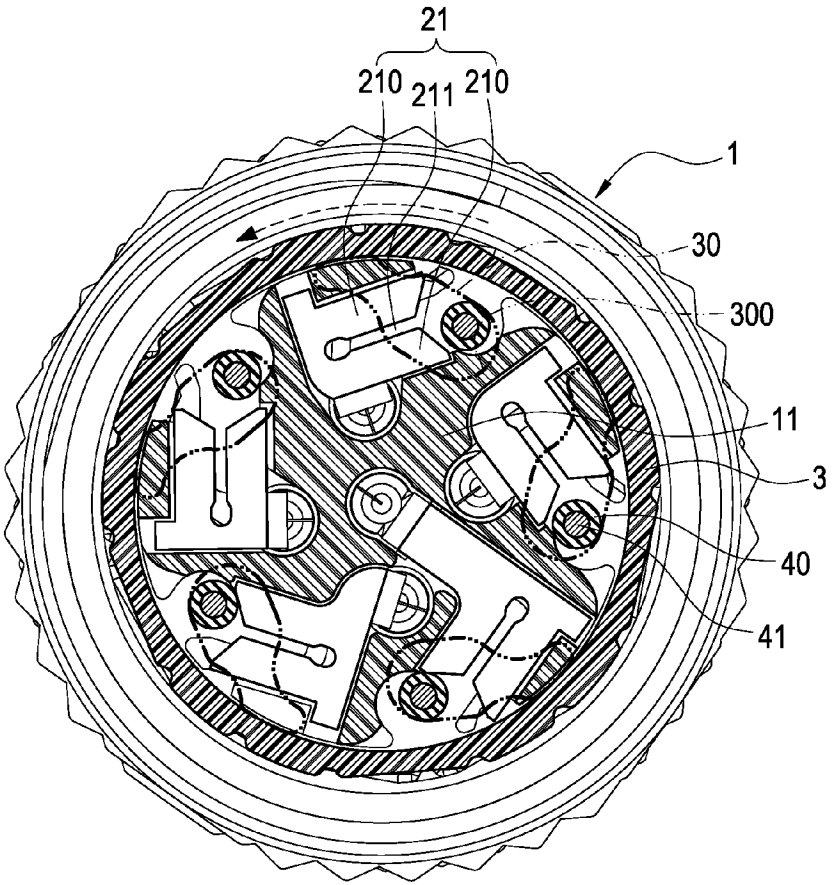
FIG. 9 is another actuating view according to another embodiment of the present invention for the insertion of the signal lines.
Figure 10:
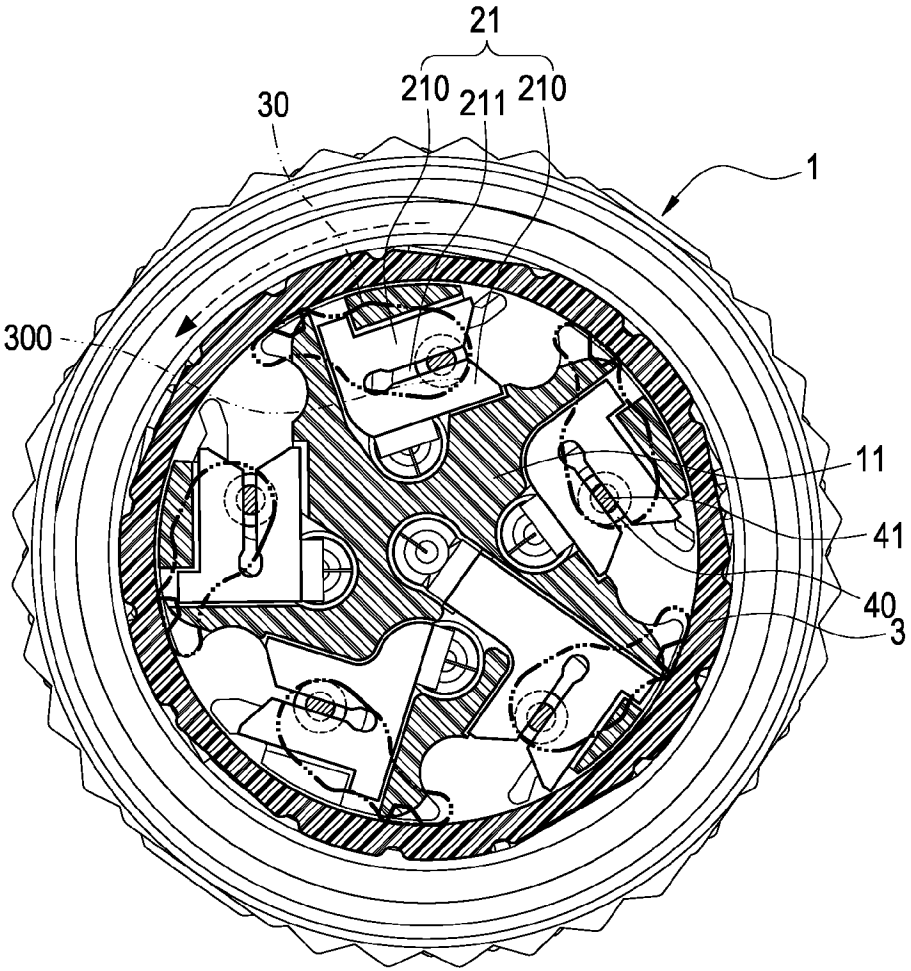
FIG. 10 is yet another actuating view according to another embodiment of the present invention for the insertion of the signal lines.

Therefore, as shown in FIGS. 8 and 9, when the rotary cable coupler 3 rotates counterclockwise, the pressing surfaces 300 in the plug holes 30 will push and move the signal lines 40 towards the slots 211 of the piercing members 21 such that the two piercing blades 210 will contact with the wire cores 41 of the signal lines 40 to achieve the electrical connection, as shown in FIG. 10.

As a result, a wiring structure improvement of an insulation piercing connector of the present invention can be achieved by means of the configuration of the above structures.

Therefore, by means of the wiring structure improvement of the insulation piercing connector of the present invention, the insertion of the signal lines into the insulation piercing connector can be more easily carried out via the rotary cable coupler and the tasks of piercing and electrical contact of all the signal lines of the connector can be accomplished simultaneously via the rotary cable coupler, which reduce human error and consuming working hours.

In summary, the present invention can achieve the expected objective and overcome the disadvantages of the prior art. Also it is indeed novel, useful, and non-obvious to be patentable. Please examine the application carefully and grant it as a formal patent for protecting the rights of the inventor.

The embodiments described above are only preferred ones of the present invention and not to limit the claimed scope of the present invention. Therefore, all the equivalent modifications and variations applying the contents of the description and the figures of the present invention should be embraced by the claimed scope of the present invention

What is claimed is:

1. A wiring structure improvement of an insulation piercing connector for electrical connection after a plurality of signal lines (40) being inserted, the wiring structure improvement comprising:

a connector body (1) having a connecting end (10) and a wiring end (11);

a plurality of terminals (2) disposed in the connector body (1), wherein each of the terminals (2) has a terminal body (20) extending from the connecting end (10) to the wiring end (11) and a piercing member (21) formed at one end of the terminal body (20) and disposed at the wiring end (11); and a rotary cable coupler (3) sleeved around the wiring end (11) and having a plurality of plug holes (30) corresponding to the piercing members (21) for insertion of the signal lines (40), whereby when the rotary cable coupler (3) is rotated, the signal lines (40) are pushed by the plug holes (30) towards the piercing members (21) correspondingly such that the piercing members (21) pierce the signal lines (40) for the electrical connection.

2. The wiring structure improvement of the insulation piercing connector according to claim 1, wherein the connecting end (10) and the wiring end (11) are disposed at two ends of the connector body (1), respectively.

3. The wiring structure improvement of the insulation piercing connector according to claim 1, wherein a plurality of through-holes (110) are disposed at the wiring end (11) of the connector body (1), wherein the piercing member (21) of each of the terminals (2) is corresponding to one side of the respective through-hole (110).

4. The wiring structure improvement of the insulation piercing connector according to claim 1, wherein the rotary cable coupler (3) has a cap-like shape.

5. The wiring structure improvement of the insulation piercing connector according to claim 1, wherein the rotary cable coupler (3) is provided with a line fastener (31) having a plurality of fixing holes (310) corresponding to the respective plug holes (30).

6. The wiring structure improvement of the insulation piercing connector according to claim 5, wherein each of the fixing holes (310) is formed and surrounded by two hook portions (311) oppositely spaced on the line fastener (31), wherein an embedded slot (312) is formed between the two hook portions (311).

7. The wiring structure improvement of the insulation piercing connector according to claim 1, wherein each of the plug holes (30) has decreasing diameters, wherein a pressing surface (300) is disposed on an inner edge of each plug hole (30), which is located at an end with the largest diameter.

8. The wiring structure improvement of the insulation piercing connector according to claim 1, wherein the piercing members (21) are disposed on a side surface of the wiring end (11).

9. The wiring structure improvement of the insulation piercing connector according to claim 8, wherein the piercing members (21) are arranged circularly.

10. The wiring structure improvement of the insulation piercing connector according to claim 1, wherein each of the piercing members (21) has two spaced apart piercing blades (210), wherein a slot (211) is formed between the two piercing blades (210).

11. The wiring structure improvement of the insulation piercing connector according to claim 10, wherein the slot (211) of each piercing member (21) has a "Y" shape.

12. The wiring structure improvement of the insulation piercing connector according to claim 10, wherein the slot (211) of each piercing member (21) is arranged to have a direction opposite to that of the rotation of the rotary cable coupler (3) to pierce the signal lines (40).

* * * * *